US009233813B2

(12) United States Patent
Mandel et al.

(10) Patent No.: US 9,233,813 B2
(45) Date of Patent: Jan. 12, 2016

(54) MEDIA REGISTRATION SYSTEM WITH SHEET CURL CONTROL

(71) Applicant: Xerox Corporatoin, Norwalk, CT (US)

(72) Inventors: Barry P. Mandel, Fairport, NY (US); Marina L. Tharayil, Rochester, NY (US); Donald E. Johnston, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/217,872

(22) Filed: Mar. 18, 2014

(65) Prior Publication Data

US 2014/0197595 A1 Jul. 17, 2014

Related U.S. Application Data

(63) Continuation of application No. 13/084,685, filed on Apr. 12, 2011, now Pat. No. 8,702,094.

(51) Int. Cl.

| | |
|---|---|
| ***B65H 9/00*** | (2006.01) |
| ***B41J 11/00*** | (2006.01) |
| ***B65H 7/02*** | (2006.01) |
| ***B65H 29/52*** | (2006.01) |

(52) U.S. Cl.

CPC ..... *B65H 9/002* (2013.01); *B41J 11/0005* (2013.01); *B65H 7/02* (2013.01); *B65H 29/52* (2013.01)

(58) Field of Classification Search

CPC ..... B65H 7/02; B65H 9/002; B65H 29/52

USPC ..... 270/1.01, 18, 58.02, 58.27; 271/184, 271/188, 185, 226, 227, 228, 249, 252, 253

See application file for complete search history.

(56) References Cited

U.S. PATENT DOCUMENTS

| | | | | | |
|---|---|---|---|---|---|
| 4,475,896 | A * | 10/1984 | Bains | 493/454 |
| 5,765,093 | A * | 6/1998 | Funato | 399/406 |
| 5,933,697 | A * | 8/1999 | Onodera et al. | 399/406 |
| 6,019,365 | A * | 2/2000 | Matsumura | 271/227 |
| 6,065,383 | A * | 5/2000 | Takaishi et al. | 83/368 |
| 6,155,561 | A * | 12/2000 | Mandel | 271/254 |
| 6,181,908 | B1 * | 1/2001 | Leemhuis et al. | 399/406 |
| 6,246,860 | B1 * | 6/2001 | Ohmichi | 399/406 |
| 7,195,238 | B2 * | 3/2007 | Suga et al. | 271/228 |
| 8,328,188 | B2 * | 12/2012 | Mandel et al. | 271/228 |
| 2001/0024012 | A1 * | 9/2001 | Kato | 271/225 |
| 2008/0310900 | A1 * | 12/2008 | Lee | 399/406 |

* cited by examiner

*Primary Examiner* — Leslie A Nicholson, III

(74) *Attorney, Agent, or Firm* — Hoffmann & Baron, LLP

(57) ABSTRACT

According to aspects illustrated herein, a system, a printmaking device, and a method for pre-curling and registering media are provided herein. The system includes a media curler system and a deskew mechanism. The media curler system pre-curls at least one of lead edge and a trail edge of a sheet before delivery to a media hold-down transport. The deskew mechanism is coupled to the media curler system for pivoting the media curler system about a pivot axis to deskew the sheet. The pivot axis extends perpendicular to the media transport path. In operation, as the lead edge enters the pre-curling and registration system, the media curler system pre-curls the sheet towards the media hold-down transport. As the sheet is being pre-curled, the deskew mechanism pivots the media curler system about the pivot axis to correct any skew errors in the sheet.

5 Claims, 8 Drawing Sheets

MEDIA REGISTRATION SYSTEM WITH SHEET CURL CONTROL

CROSS-REFERENCE TO RELATED APPLICATIONS

This application claims the priority benefit under 35 U.S.C. §120 as a continuation of U.S. patent application Ser. No. 13/084,685, filed 12 Apr. 2011, and having the same title and inventive entity as the instant application. The complete disclosure of the aforementioned and/or priority application is hereby incorporated by reference for all purposes.

TECHNICAL FIELD

This disclosure relates to registration systems for a printmaking device. More specifically, registration systems that include a media curling function and result in a reduced media transport path are disclosed herein.

BACKGROUND

Direct marking systems include inkjet print heads that print directly on a print media. Examples of direct marking systems include high speed media vacuum transport systems and media against vacuum drums systems. Direct marking systems require the media in the print zone to be extremely flat. Keeping the media extremely flat may present significant challenges.

Testing has shown that pre-curling the media in a downward direction may significantly help reduce the hold-down pressures required during printing. However, performing pre-curling creates challenges. A first challenge is that pre-curling may cause the media transport path to be extended, increasing the machine footprint.

Another challenge is registering the media on the media transport path, while keeping the media properly curled. For example, if pre-curling is performed prior to the registration of the media, the registration of the media may adversely affect the curl of the media. On the other hand, if the media is curled after the registration, the media may become misaligned during the curling process.

Accordingly, it would be desirable to provide a registration system that pre-curls and registers the media along a reduced media transport path.

SUMMARY

According to aspects illustrated herein, there is provided a system for pre-curling and registering media includes a media curler system and a deskew mechanism. The media curler system pre-curls at least one of a lead edge and a trail edge of a sheet before delivery to a media hold-down transport. The sheet includes the lead edge, the trail edge, and a first side edge and a second side edge therebetween, with the lead edge approximately parallel to the trail edge. The deskew mechanism is coupled to the media curler system for pivoting the media curler system about a pivot axis to deskew the sheet. The pivot axis extends perpendicular to the media transport path. As the lead edge enters the pre-curling and registration system, the media curler system pre-curls the sheet towards the media transport path. As the sheet is being pre-curled, the deskew mechanism pivots the media curler system about the pivot axis to correct any skew errors in the sheet.

According to other aspects illustrated herein, there is provided a printmaking device for pre-curling and registering media including: a media transport path, a pre-curling and registration system, and printing module. The media transport path is adapted to move a sheet of media including a lead edge, a trail edge, and a first side edge and a second side edge therebetween, with the lead edge approximately parallel to the trail edge. The pre-curling and registration system along the media transport path includes a media curler system and a deskew mechanism. The media curler system is configured to pre-curl at least one of the lead edge and the trail edge of the sheet towards the media transport path. The deskew mechanism is coupled to the media curler system for pivoting the media curler system about a pivot axis to deskew the sheet. The pivot axis extends perpendicular to the media transport path. The printing module includes a hold-down transport for transporting the sheet past a marking system, operatively connected to the media transport path. The printing module is configured to prints an image on the pre-curled sheet. In operation, the media transport path moves the sheet in a process direction and the lead edge enters the pre-curling and registration system. The media curler system pre-curls the sheet towards the media hold-down transport. As the sheet is being pre-curled, the deskew mechanism pivots the media curler system about the pivot axis to correct any skew errors in the sheet. The media transport path moves the sheet from the pre-curling and registration system to the printing module.

According to further aspects illustrated herein, there is provided a method for pre-curling and registering media. The method includes the following steps. Moving a sheet of media along a media transport path in a process direction to a pre-curling and registration system. The sheet having a lead edge, a trail edge, and a first side edge and a second side edge therebetween, with the lead edge approximately parallel to the trail edge. Simultaneously, pre-curling the sheet towards the media transport path, and pivoting the sheet about a pivot axis to correct any skew errors in the sheet. The pivot axis extends perpendicular to the media transport path and traverses the media transport path. Delivering the sheet to a printing module.

Additional features and advantages will be readily apparent from the following detailed description, the accompanying drawings, and the claims. It is to be understood, however, that the drawings are designed as an illustration only and not as a definition of the limits of the disclosure.

BRIEF DESCRIPTION OF THE DRAWINGS

Like reference symbols in the various drawings indicate like elements.

DETAILED DESCRIPTION

Figure 1:
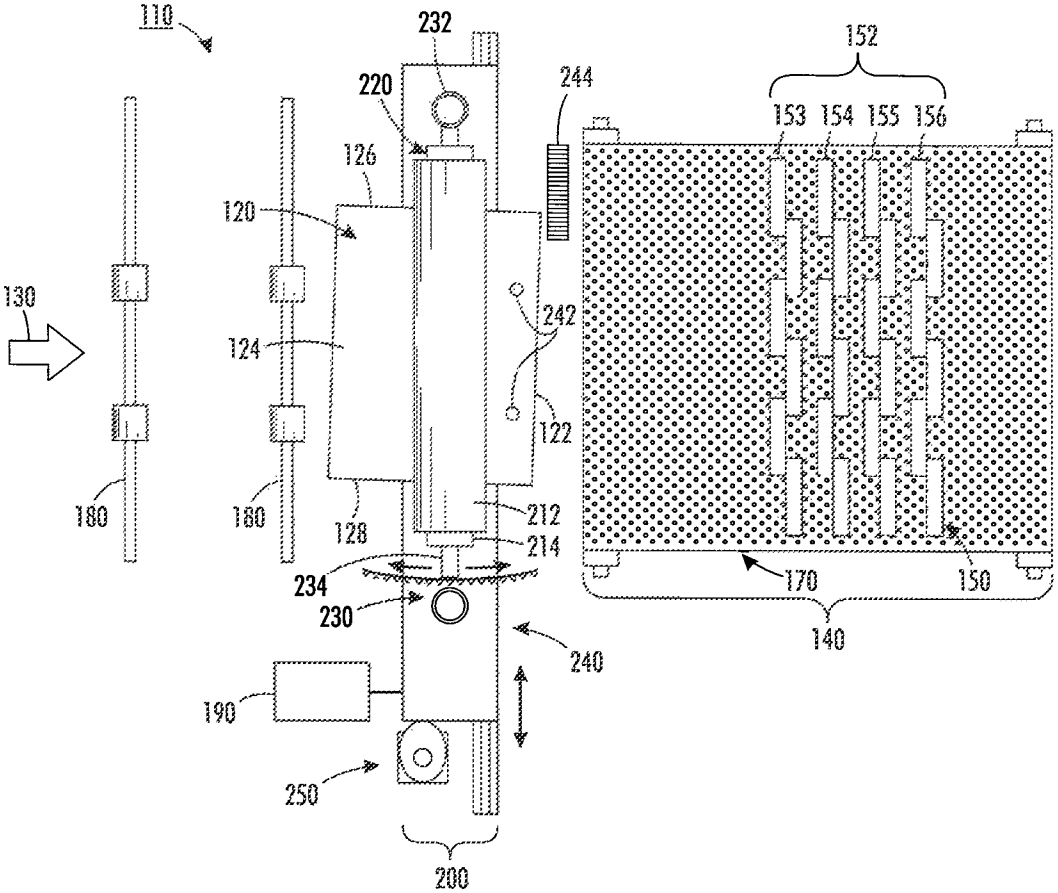
FIG. 1 illustrates a plan view of a printmaking device with a pre-curling and registration system.

A method, system, and printmaking device are disclosed herein that provide for pre-curling and registering a sheet of media along a media transport path without extending the media transport path. The pre-curling and registering of the sheet may be accomplished through the use of a system that in tandem pre-curls and registers the sheet on a reduced media transport path prior to the sheet reaching a printing module of a printmaking device. The pre-curling and registering of the sheet may be used to ensure the sheet remains properly curled and aligned prior to entering the printing module, which is important for direct marking printing modules.

As used herein, the phrase "printmaking device" encompasses any apparatus, such as, a digital copier, a bookmaking machine, a facsimile machine, and a multi-function machine, which performs a printing outputting function for any purpose.

As used herein, the term "sheet" and the phrase "sheet of media" encompass, for example, one or more of a usually flimsy physical sheet of paper, heavy media paper, coated papers, transparencies, parchment, film, fabric, plastic, or other suitable physical print media substrate on which information can be reproduced.

As used herein, the phrase "lead edge" refers to the edge of a sheet of media that first advances along the substrate conveyance path.

As used herein, the phrase "trail edge" refers to the edge of a sheet of media opposite the lead edge. The trail edge is substantially parallel to the lead edge.

As used herein, the phrase "media transport path" encompasses any apparatus for separating and/or conveying one or more sheets into a substrate conveyance path inside a printmaking device.

As used herein, the phrase "fixed reference" refers to the alignment and configuration of the sensor, which points at a non-changing location on the feed path.

As used herein, the term "lateral position" refers to a position of the sheet with respect to a lateral or cross-process location on the feed path.

As used herein, the term "sensor" refers to a sensor that detects the position of a sheet edge. It may use intensity or brightness of light or other physical phenomena. For example, the sensor may be an optical sensor.

As used herein, the terms "registering" and "registration" refer to determining the proper alignment of a sheet and/or a printing apparatus with respect to a fixed reference.

As used herein, "rollers" refer to shafts, rods, cams, and the like, that rotate about a center axis. Rollers can facilitate rotation of a belt about the rollers and/or form nips through which a sheet of media passes.

As used herein, the phrase "process direction" refers to a direction that the feed path moves a sheet.

As used herein, the phrase "cross-process direction" refers to a direction perpendicular to the direction that the feed path moves a sheet of media.

As used herein, the phrase "hold-down transport" refers to an apparatus for holding a sheet of media flat as it passes through the print zone of a printing system.

As used herein the phrase "printing module" refers to a marking device that uses marking technologies, such as, a direct marking device that uses inkjet print heads.

As used herein the phrases "media curler" or "media curler system" refer to a system for applying a curl to a sheet of media. For example, the system may include a combination of one or more rollers and/or a belt and/or a baffle configured to increase the curl of a sheet of media.

As used herein, the phrase "lateral motion motor" refers to a device configured to move an apparatus laterally or in a cross-process direction based on a fixed point along the feed path.

As used herein, the term "skew" refers to an angular error in the position of the sheet along the feed path.

As used herein, the phrase "deskew mechanism" refers to an apparatus for removing skew. The deskew mechanism may be configured to adjust a sheet of media and/or print heads to remove skew.

As used herein the phrase "pivot axis" refers to an axis of rotation that is centered about a fixed reference.

As used herein the phrase "registration controller" refers to a device capable of collecting data from sensors, analyzing data, and controlling movement of registration nips.

As used herein, the terms "pre-curl" and "pre-curling" refer to curling a sheet of media prior to the sheet entering a marking device. For example, the sheet may be curled along the media transport path prior to entering the printing module.

Figure 2:
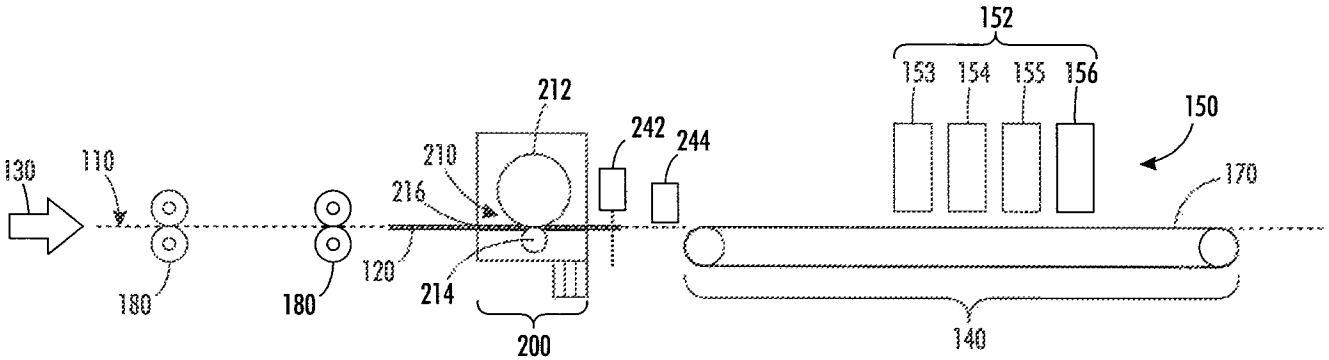
FIG. 2 illustrates a side view of the printmaking device of FIG. 1.

FIGS. 1-2 provide a printmaking device 100 with a pre-curling and registration system 200 along a media transport path 110. The media transport path 110 is configured to move a sheet of media 120 in a process direction 130 through the printmaking device 100. For example, the media transport path 110 may transport the sheet 120 through the pre-curling and registration system 200 and the printing module 140. A portion of the media transport path 110 may be configured to be a media hold-down transport 170 for holding the sheet 120 flat against the media transport path 110. For example, the media hold-down transport 170 may be a vacuum transport 172 that holds the sheet 120 flat as the sheet 120 moves through the printing module 140. The sheet 120 may include a lead edge 122, a trail edge 124, and two side edges therebetween 126, 128.

Figure 3:
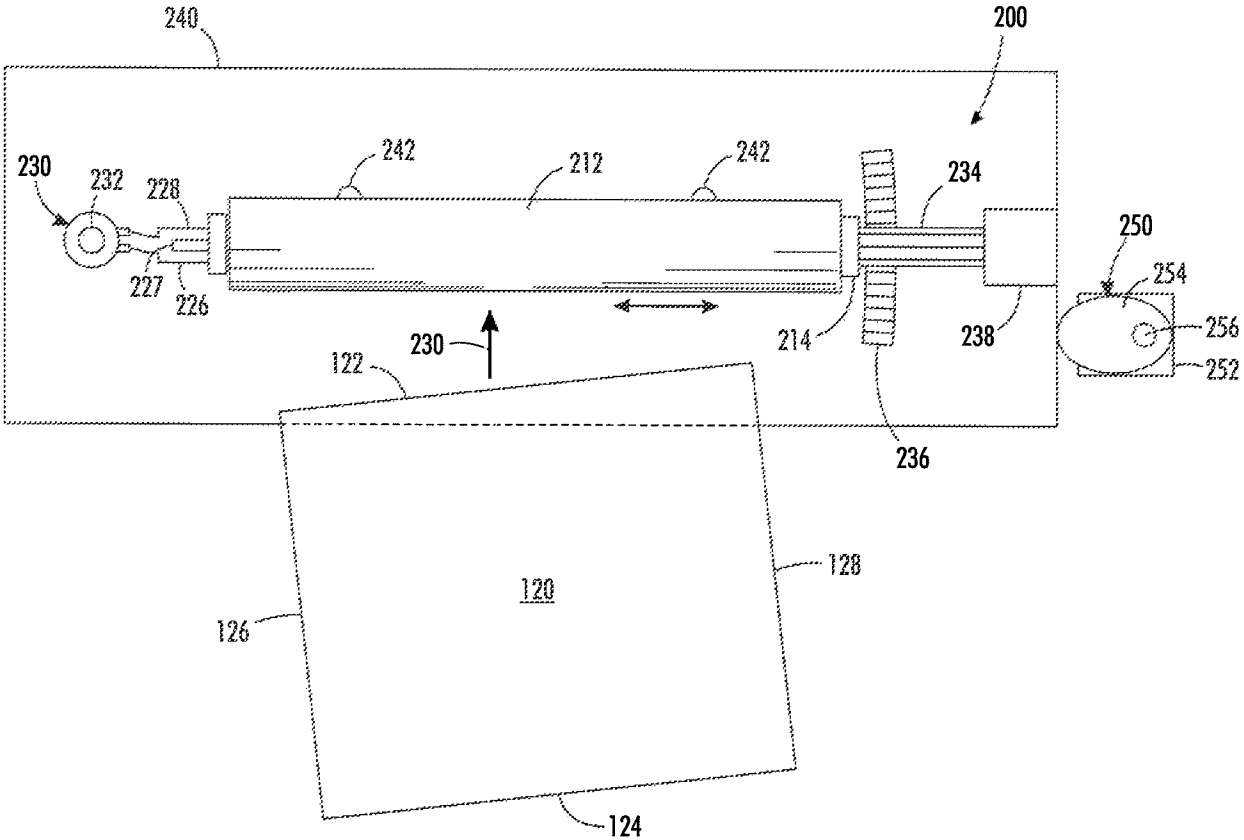
FIG. 3 illustrates a plan view of a pre-curling and registration system for use with the printmaking device of FIGS. 1-2.

The pre-curling and registration system 200 as shown in FIGS. 1-3 may include a media curler system 210, a deskew mechanism 230, and a lateral motion motor 252.

The media curler system 210 may be configured to curl the sheet 120 towards the media hold-down transport 170. Although the media transport path 110 and marking system (e.g., printing module 140) are shown in a horizontal orientation in FIG. 2, it should be appreciated that the direction of the media transport path 110 may be downwards, sideways, or upwards depending on the media path architecture of the printmaking device 100. The media curler system 210 may further be configured to curl the lead edge 122 of the sheet 120, the trail edge 124 of the sheet 120, or both the lead edge 122 and the trail edge 124 of the sheet 120. Moreover, the media curler system 210 may be configured to impart variable levels of curl on the sheet 120.

As shown in FIGS. 1-3, the media curler system 210 may be a penetrating nip curler 220. The penetrating nip curler 220 may curl the sheet 120 towards the media hold-down transport 170 using two rollers, a soft roller 212 (or compressible roller) and a hard roller 214 that form a nip (a deskew nip 216). The soft roller 212 and the hard roller 214 may be placed along the media transport path 110 in vertical alignment with one another. The hard roller 214 may be configured to be positioned on the same side of the media transport path 110 as the media hold-down transport 170 so as to curl the sheet 120 towards the media hold-down transport 170, while the soft roller 212 engages with the hard roller 214.

Each of the soft roller 212 and the hard roller 214 may have a rod through the center thereof. The soft roller 212 may be configured to rotate about the axis of a first rod 226 and the hard roller 214 may be configured to rotate about the axis of a second rod 228. The first rod 226 and the second rod 228 may be connected to a frame 227.

Figure 4:
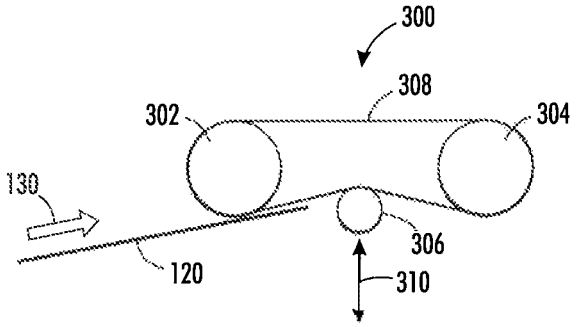
FIG. 4 illustrates a side view of a belt and curler pre-curl system for use with the printmaking device of FIGS. 1-2.
Figure 5:
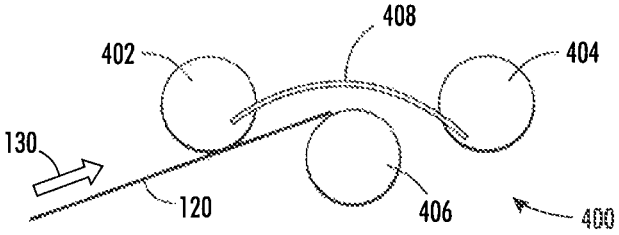
FIG. 5 illustrates a side view of a three roll and baffle pre-curl system for use with the device of FIGS. 1-2.

As one skilled in the art may appreciate, various other media curler system 210 may be utilized. FIGS. 4-5 show two other exemplary media curler systems 210.

FIG. 4 shows a belt and curler 300. The belt and curler 300 may include three rollers and a belt. The three rollers may be spaced apart from one another in an alternating configuration and a belt may be configured to connect the three rollers. In operation, the belt and curler 300 may use the belt and the three rollers to move the sheet 120 through the media curler system 210 and curl the sheet 120 accordingly.

For example, the belt and roll curler 300 may include two larger rollers 302, 304, one smaller roller 306, and a belt 308 operatively connected thereto. As shown in FIG. 4, the belt 308 may be positioned to wrap around the two larger rollers 302, 304 and to lie between the larger rollers 302, 304 and the smaller roller 306, such that, a portion of the belt 308 contacts the smaller roller 306. The two larger rollers 302, 304 may rotate in a direction opposite the media transport path 100 to move the belt 308 in the process direction while the smaller roller 306 remains in contact with the belt 308 and moves with the belt 308 in the process direction 130.

As the sheet 120 moves through the belt and curler 300, the belt 308 curls the sheet 120 by directing the sheet 120 between the belt 308 and the smaller roller 306. The pressure of the belt 308 and the curve of the smaller roller 306 are used to curl the sheet 120 towards the media transport path 110 (not shown in FIG. 4). As one skilled in the art may appreciate, the smaller roller 306 may further be configured to move vertically in relation to the belt 308 and/or the larger rollers 302, 304 to provide various amounts of curl to the sheet 120.

FIG. 5 shows a three roll and baffle curler system 400. The three roll and baffle curler system 400 may include three rollers and a baffle 408. The three rollers may be spaced apart from one another in an alternating configuration with an interior roller 406 lying between two exterior rollers, a first exterior roller 402 and a second exterior roller 404 and the baffle 408 may be positioned between the first and second exterior rollers 402, 404. The baffle 408 may be configured to guide the sheet 120 from the first exterior roller 402 to second exterior roller 404 and direct the sheet 120 to curl around the interior roller 406 towards the media transport path 110 (not shown in FIG. 5). As one skilled in the art may appreciate, the baffle 408 may include various configurations depending on the rollers and media being used. Moreover, various types of rollers may be used.

For example, FIG. 5 shows each of the three rollers 402, 404, 406 being high friction rollers and the baffle 408 may overlie the interior roller 406 and extend between the first and second exterior rollers 402, 404. In operation, the first and second exterior rollers 402, 404 and the interior roller 406 may be configured such that the first exterior roller 402 contacts the sheet 120 and moves the sheet 120 in the process direction 130. The interior roller 406 may also move the sheet 120 in the process direction 130. As the sheet 120 moves over the interior roller 406, the sheet 120 may contact and be guided by the baffle 408 to the second exterior roller 404. The second exterior roller 404 may continue to guide the sheet 120 in the process direction 130 through the three roll and baffle curler system 400.

As one skilled in the art may appreciate, the interior roller 406 may further be configured to move vertically in relation to the baffle 408 and/or the exterior rollers 402, 404 to provide various amounts of curl to the sheet 120.

With regards to FIGS. 1-3, the media curler system 210 may be attached to the deskew mechanism 230. As shown in FIG. 3, the deskew mechanism 230 may include a pivot point 232, a pinion gear 234, and a pinion rack 236. The pinion gear 234 may be connected to the pivot point 232 using one or more rods. For example, FIG. 3 shows the media curler system as a penetrating nip curler 220 having a first rod 226 and a second rod 228. The first and second rods 226, 228 may be configured to be attached to a frame 227 that is attached to the pinion gear 234 and the pivot point 232.

The attachment of the one or more rods to the deskew mechanism 230 may allow adjustment of the media curler system 210 to correct registration errors, such as, skew and/or lateral (cross-process) position errors, while the sheet 120 is being curled. The adjustment of the media curler system 210 may include rotating the media curler system 210 and/or moving the media curler system 210 laterally. As one skilled in the art may appreciate, the media curler system 210 may be attached to the deskew mechanism 230 in various ways, and various configurations of the deskew mechanism 230 may be used.

In operation, the deskew mechanism 230 of FIG. 3 may adjust the position of the media curler system 210 by engaging the pinion gear 234 with the pinion rack 236. The movement of the pinion gear 234 along the pinion rack 236, in turn pivots the penetrating nip curler 220. The pinion gear 234 may be attached to a gear hub 238 that is mounted to a motor or includes a motor that is configured to drive the pinion gear 234 along the pinion rack 236. The pinion rack 236 may be made of plastic and may be slightly curve about an arc centered on the axis of rotations defined by the pivot point 232.

The deskew mechanism 230 may measure a skew of the sheet 120 prior to the sheet entering the deskew nip 216. The deskew mechanism 230 may then pre-skew the media curler system 210 prior to the sheet entering the deskew nip 216 and then straighten the media curler system 210 and the sheet 120, while the sheet 120 is being pre-curled in the media curler system 210. Alternatively, the deskew mechanism 230 may not be pre-skewed and may adjust according to the sheet 120 skew after the sheet 120 enters the deskew nip 216. As one skilled in the art may appreciate, the operation of the deskew mechanism 230 may vary depending the printmaking device 100.

The deskew mechanism 230 may also include one or more sensors. For example, the deskew mechanism 230 may include two point sensors 242 along the media transport path 110. As one skilled in the art may appreciate, the two point sensors 242 may be configured to detect skew errors in the sheet 120 by measuring the skew of the lead edge 122 of the sheet 120 using any known method. The pre-curling and registration system 200 may then adjust the sheet 120 with the deskew mechanism 230 described herein and/or using methods for correcting skew errors known to one skilled in the art.

The deskew mechanism 230 may further include a carriage 240. The carriage 240 may be operatively connected to the deskew mechanism 230 along the media transport path 110.

The lateral motion motor 252 may be coupled to the media curler system 210 and/or the deskew mechanism 230. For example, the lateral motion motor 252 may be attached to the carriage 240 of the deskew mechanism 230. The lateral motion motor 252 may be configured to counteract the angled velocity vector of the media curler system 210 that may cause the sheet 120 to be skewed.

Specifically, the lateral motion motor 252 may be a lateral motion motor and cam assembly 251 may be used to laterally register the sheet 120. The lateral motion motor and cam assembly 251 may include a lateral motion motor 252 with a cam 254 and a shaft 256. The lateral motion motor and cam assembly 251 may be configured to laterally move the pre-curling and registration system 200 as the deskew mechanism 230 rotates the carriage 240. For example, during lateral registration of the sheet 120, the end location of the sheet 120 may be measured using an array sensor, and the image may be shifted laterally to match the location of the sheet 120. However, as one skilled in the art may appreciate, the lateral motion motor and cam assembly 251 may be used to shift the entire media curler system 210, as shown in FIGS. 1-3, or another mechanism configured to perform this lateral movement using one of more methods known in the art.

The pre-curling and registration system 200 may further include one or more array sensors 244. As one skilled in the art may appreciate, the one or more array sensors 244 may be configured to detect lateral errors in the sheet 120 by measuring one of the side edges 126 of the sheet. The pre-curling and registration system 200 may then adjust the sheet 120 accordingly using a known method for correcting lateral errors, such as, using the lateral motion motor 252.

Figure 6:
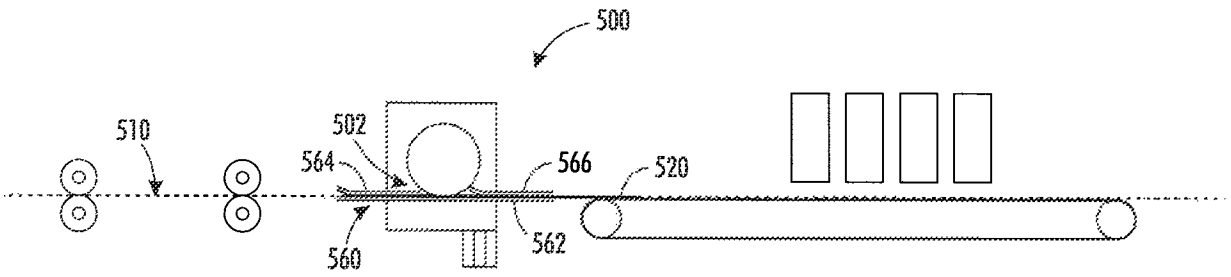
FIG. 6 illustrates a side view of a printmaking device with a heater system.

The printmaking device 100 may further include a heater assembly. FIG. 6 shows an exemplary printmaking device 500 including a heater assembly 560. The heater assembly 560 may be along a media transport path 510. The heater assembly 560 may be configured to heat the sheet 520 prior to the sheet 520 entering the pre-curling and registration system 502, during the pre-curling and registration, and/or after the sheet exits the pre-curling and registration system 502. Moreover, the heater assembly 560 may be integrated with the pre-curling and registration system 502, such that, the heater assembly rotates and moves with the pre-curling and registration system 502 or the heater assembly may be configured to be separate and remain stationary along the media transport path 510. As one skilled in the art may appreciate, the heater assembly 560 contemplated may include various configurations known in the art.

For example, the heater assembly 560 shown in FIG. 6 includes a set of heated, floating plates and/or a radiant plate. For example, the plates may include a first floating plate 562 located below the media transport path 510. The plates may also include a second floating plate 564 located above the media transport path 510 in a position where the sheet 520 would pass below the second plate 564 prior to entering the pre-curling and registration system 502. The plate may further include a third radiant plate 566 located below the media transport path 510 such that the sheet 520 would pass above the third plate 564 prior to and after exiting the pre-curling and registration system 502. As one skilled in the art may appreciate, other variations and combinations of heating assemblies may be utilized depending on the printmaking device and/or the pre-curling and registration system.

The printmaking device 100 may also include a printing module 140. The printing module 140 may include a marking system 150 with one or more inkjet print heads 152. For example, there may be four rows of inkjet print heads 152 in the marking system 150 a row of black 153, a row of cyan 154, a row of magenta 155, and a row of yellow 156. As one skilled in the art may appreciate, the printing module 140 may be located along the media transport path 110 or operatively connected to the media transport path 110.

Figure 7:
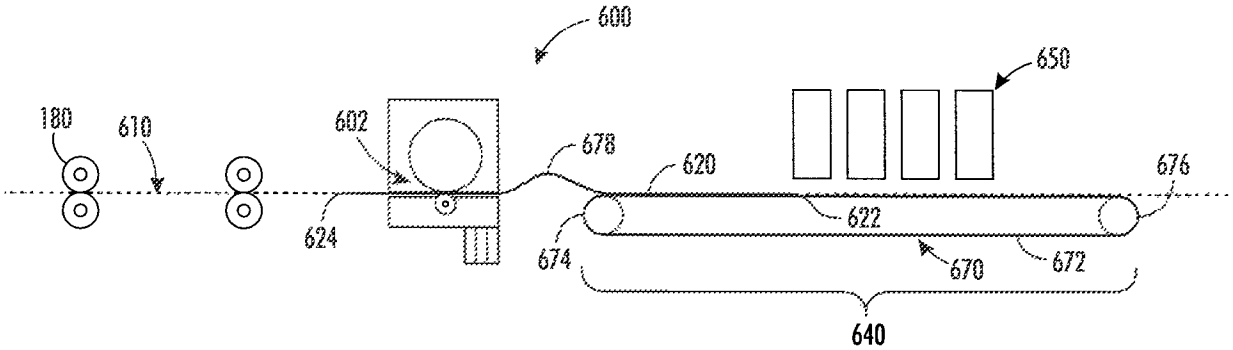
FIG. 7 illustrates a side view of a printmaking device with a hold-down transport.

The printmaking device 100 may further include a hold-down transport 170. FIG. 7 shows an exemplary printmaking device 600 with a hold-down transport 670 in the printmaking module 640. The hold-down transport 670 may include a belt 672 that transports a sheet 620 past the print head arrays 650. The belt 672 may be further configured to hold the sheet 620 "down" flat so the sheet 620 does not stick up and/or contact the print heads. The belt 672 may be driven at a pre-determined velocity by, for example, a set of rollers 674, 676. As one skilled in the art may appreciate, various types of hold-down transports 170 are contemplated, such as vacuum transports, electrostatic transports and the like.

The hold-down transport 670 may also be configured to create a buckle 678 in the sheet 620 between a lead edge 622 and a trail edge 624 of the sheet 620. The buckle 678 may reduce motion quality disturbances during the marking process. For example, as the sheet 620 is handed off between the pre-curling and registration system 602 and the hold-down transport 670 a buckle 678 may be created along a media feed path 610 between the pre-curling and registration system 602 and the belt 672 of the hold-down transport 670. The buckle 578 may be created by adjusting the speed of the sheet 620 along the media transport path 610, such that the speed of the media transport path 610 may vary to naturally create a buckle 678 in the sheet 620.

For example, the media transport path 610 in the pre-curling and registration system 602 may be sped up and the speed of the hold-down transport 670 may be kept consistent. By speeding up the media transport path 610 in the pre-curling and registration system 602, the buckle 678 will naturally be created along the hold-down transport 670. Alternative variations in speed, such as slowing down the speed of the hold-down transport 670 or a combination of slowing down the hold-down transport 670 and speeding up the media transport path 610 in the pre-curling and registration system 602 may be utilized, as one skilled in the art may appreciate.

Furthermore, the printmaking device 100 may include one or more pre-registration nips 180 along the media transport path 110. The pre-registration nips 180 may be configured to assist with the movement of the sheet 120 along the media transport path 110. The pre-registration nips 180 may also be releasable to avoid any interference with the pre-curling and registration system 200. For example, during deskewing the pre-registration nips 180 may release from the sheet 120 to avoid a portion of the sheet 120 getting "stuck" or "jammed" under on of the pre-registration nips 180.

The printmaking device 100 may further include a controller 190. The controller 190 may be operatively connected and/or integrated into the pre-curling and registration system 200. The controller 190 may be configured to control one or more of the media curler system 230, the deskew mechanism, and/or the lateral motion motor. The controller 190 may further be configured to communicate with the sensors along the media transport path 110 and/or other modules in the printmaking device, such as the printing module 140.

In operation, the printmaking device 100 of FIGS. 1-2 moves the sheet 120 in the process direction 130 along the media transport path 110 towards the per-curling and registration system 200 and the printing module 140. The printmaking device 100 may use pre-curling nips 180 to assist with the movement of the sheet 120. Prior to entering the pre-curling and registration system 200, the sheet 120 may optionally be heated by a heater assembly 160 along the media transport path 110. Then, the sheet 120 may move from the media transport path 110 to the pre-curling and registration system 200.

As the lead edge 122 of the sheet 120 enters the media curler system 210 and is curled towards the media hold-down transport, the deskew mechanism 230 may begin registering the position of the sheet 120. The sheet 120 may be registered using the plurality of skew sensors 242 to determine the skew and the pivot point 232, the pinion gear 234, and the pinion rack 236 may be utilized to correct the skew errors. The deskew mechanism 230 may also use the lateral motion motor 252 to counteract the angled velocity vector of the media curler system 210, which will impart a lateral velocity to the sheet if it is positioned in a skewed orientation. During registration, lateral errors may also be determined by the one or more lateral array sensors 244 and corrected using the lateral motion motor 252.

After exiting the pre-curling and registration system 200, the sheet 120 may be transported to the printing module 140. In the printing module 140 the sheet may be transported past the marking system using the hold-down transport 170. The sheet 120 may be printed on during this time. For example, the marking system 150 may be configured for direct marking and use inkjet print heads 152 to perform direct marking on each sheet 120. As one skilled in the art may appreciate, the printmaking device 100 contemplated may be configured to perform other operations known to one skilled in the art.

Figure 8:
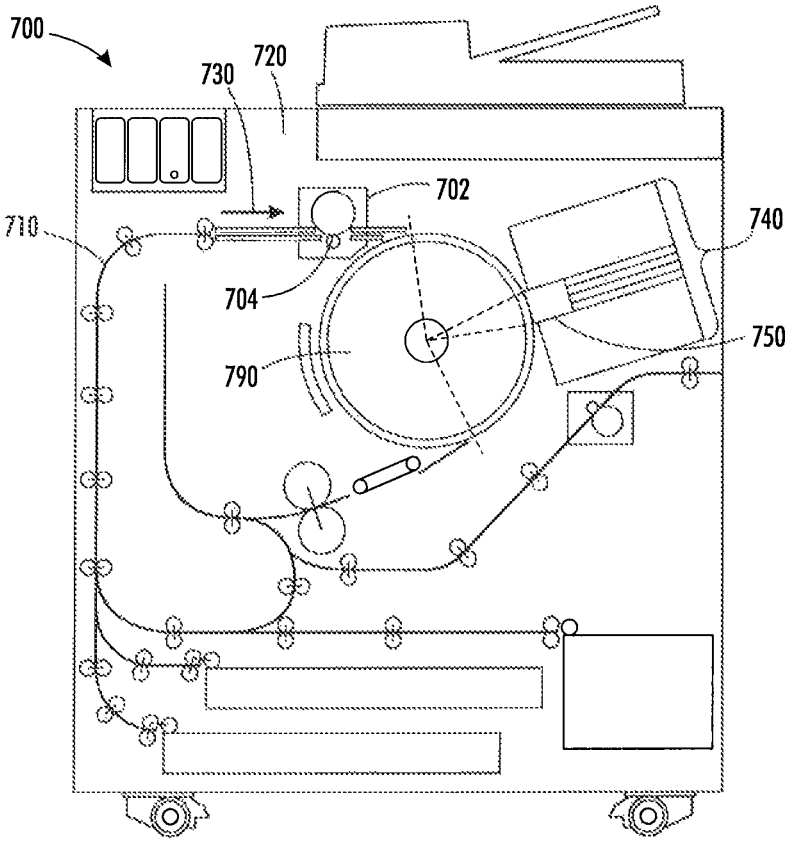
FIG. 8 illustrates a cross-section of a multi-pass drum printmaking device for use with the systems of FIGS. 3-5.

FIG. 8 illustrates a cross-section of a hold-down drum printing device 700 for use with the pre-curling and registration systems described in FIGS. 3-7. The hold-down drum printing device 700 may be a multi-pass system. The hold-down drum printing device 700 may include a media transport path 710, a pre-curling and registration system 702, a printing module 740, and a hold-down drum 790, for example, the hold-down drum 790 may be a media hold-down drum, or a multi-pass system where the paper make multiple passes to buildup an image. The hold-down drum printing device 700 may use the media transport path 710 to move a sheet of media 720 in a process direction 730 through the hold-down drum printing device 700. For example, the media transport path 710 may transport the sheet 720 through the pre-curling and registration system 702 and the printing module 740.

As discussed above, the pre-curling and registration system 200 as shown in FIGS. 1-3 may include a media curler system 210, a deskew mechanism 230, and a lateral motion motor 252.

Similarly, the pre-curling and registration system 702 may be configured to curl the sheet 720 towards the hold-down drum 790. The pre-curling and registration system 702 may include a media curler system 704, such as, a penetrating nip curlers, as shown in FIGS. 1-3; a belt and roll curler 300, as shown in FIG. 4; a three roll and baffle curler 400, as shown in FIG. 5; or another type of media curler system 704, as one skilled in the art would appreciate.

The media curler system 704 may be attached to the deskew mechanism (not shown). The deskew mechanism of the hold-down drum printing device 700 may be configured similar to that described above with reference to FIG. 3. For example, the deskew mechanism, as shown in FIG. 3, may include a pivot point 232, a pinion gear 234, and a pinion rack 236, as described with reference to FIG. 3. The deskew mechanism may also include one or more sensors configured to detect skew errors in the sheet 120. The deskew mechanism 230 may further include a carriage 240. The carriage 240 may be operatively connected to the deskew mechanism 230 along the media transport path 110.

Furthermore, a lateral motion motor (not shown) may be coupled to the media curler system 704 and/or the deskew mechanism, also described in FIG. 3 above. With reference to FIG. 3, the lateral motion motor 252 may be configured to counteract the angled velocity vector of the media curler system 210 that may cause the sheet 120 to be skewed. Alternatively, the lateral motion motor 252 may be used to laterally register the sheet 120.

In operation, a sheet 720 is moved in the process direction 730 through the printmaking device 500. The media transport path 710 leads the sheet 720 to the pre-curling and registration system 702 where the sheet 720 is curled towards the hold-down drum 790. At the same time, the deskewing mechanism may adjust the sheet using any known method, as may be appreciated by one skilled in the art.

After the sheet 720 exits the pre-curling and registration system 702, the sheet 720 moves along the media transport path 710 to the hold-down drum 790. The hold-down drum 790 carries the sheet 720 past the printing module 740, where the marking device 750 marks the sheet 720 thereby providing a hold-down drum printing device 700, as one skilled the art would appreciate.

Figure 9:
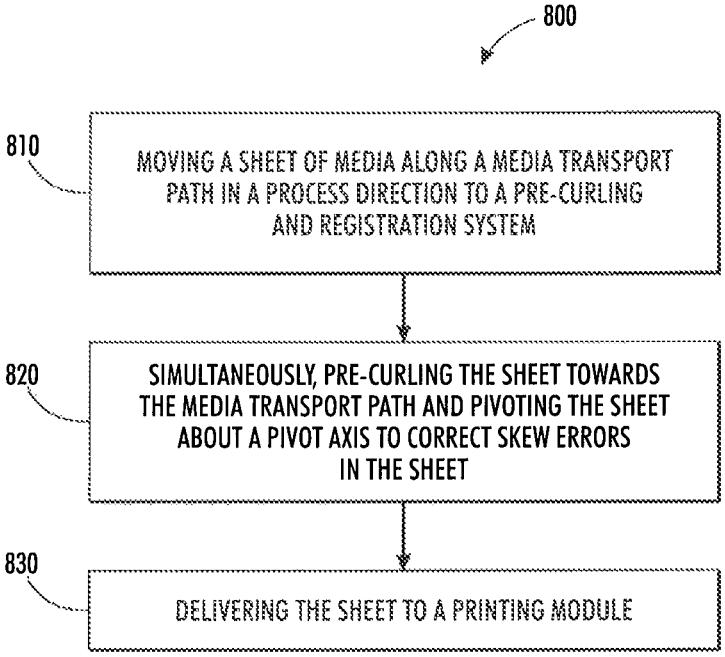
FIG. 9 illustrates a method for pre-curling and registering a sheet of media for use with the pre-curling and registration systems of FIGS. 1, 2, 3, and 6.

FIG. 9 provides a method 800 for pre-curling and registering media. As one skilled in the art may appreciate, the method 800 may be used with the pre-curling and registration systems 200 and/or the printmaking devices 100, 700 described herein. In step 810, a sheet of media is moved along a media transport path in a process direction to a pre-curling and registration system. The sheet may have a lead edge, a trail edge, and a first and second side edge therebetween. The lead edge may be approximately parallel to the trail edge. The sheet may simultaneously be pre-curled towards the media transport path and pivoted about a pivot axis to correct any skew errors at step 820. The pivot axis may be configured to traverse the media transport path and extend perpendicular to the media transport path. Then, in step 830, the sheet may be delivered to a printing module.

The method 800 of FIG. 9 may also include detecting a skew error using a plurality of point sensors. The method 800 may further include detecting a lateral error using one or more array sensors and correcting the lateral error using a lateral motion motor.

The method 800 may include pre-curling the sheet with a penetrating nip curler. The penetrating nip curler may be configured to pre-curl the lead edge, the trail edge, or both the lead edge and the trail edge of the sheet. The method may also include heating the sheet prior to and/or after the sheet being pre-curled.

Advantages of the printmaking devices 100, 700 with the pre-curling and registration systems 200, 502, 602, 702, and the method 800 provided herein include the ability to perform the pre-curling and registration of the sheet 120, 520, 620, 720 on a reduced media transport path to avoid increasing the machine footprint. A further advantage includes the ability to simultaneously pre-curl and register the sheet 120, 520, 620, 720 to provide accurate curling and alignment in one step.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A method pre-curling and registering media comprising:

moving a sheet of media along a media transport path in a process direction to a pre-curling and registration system, said sheet having a lead edge, a trail edge, and a first side edge and a second side edge therebetween, wherein said lead edge is approximately parallel to said trail edge;

simultaneously, pre-curling said sheet and pivoting said sheet about a pivot axis to correct any skew errors in said sheet, said pivot axis extends perpendicular to said media transport path and traverses said media transport path;

generating a buckle in said sheet before delivering said sheet to a printing module wherein said buckle is formed after deskewing of said sheet, and in between said pre-curling and registration system and said media hold-down transport; and delivering said sheet to said printing module.

2. A method of claim 1, further comprising detecting a skew error using a plurality of point sensors.

3. A method of claim 1, further comprising:

detecting a lateral error using one or more array sensors; and corrected said lateral error using a lateral motion motor.

4. A method of claim 1, further comprising pre-curling said lead edge and said trail edge of said sheet.

5. A method of claim 1, further comprising pre-curling said sheet with a penetrating nip curler.

* * * * *